US005702308A

United States Patent [19]

Alexander, Jr.

[11] Patent Number: 5,702,308

[45] Date of Patent: Dec. 30, 1997

[54] MINIATURE BOWLING ALLEY GAME

[76] Inventor: Delbert S. Alexander, Jr., 108½ Dodge Ave., Evanston, Ill. 60202

[21] Appl. No.: 635,737

[22] Filed: Apr. 22, 1996

[51] Int. Cl.[6] ..... A63D 3/00

[52] U.S. Cl. ..... 473/70; 473/72; 473/74; 473/116; 364/410

[58] Field of Search ..... 473/115, 116, 473/117, 74, 54, 70, 72; 273/108.1, 126 R, 127 C, 454, 455, 460, 461, 340, 127 B; 463/1, 4, 5, 3; 364/410, 411

[56] References Cited

U.S. PATENT DOCUMENTS

| | | | |
|---|---|---|---|
| 2,316,990 | 4/1943 | Seaman | 473/72 |
| 2,455,909 | 12/1948 | Smith | 473/72 |
| 2,565,238 | 8/1951 | Koci | 473/74 |
| 2,572,456 | 10/1951 | Durant | 473/74 |
| 2,643,884 | 6/1953 | Koel . | |
| 3,063,719 | 11/1962 | Rosenberger | 473/74 |
| 3,195,892 | 7/1965 | Hildebrant . | |
| 3,703,288 | 11/1972 | Vogel | 473/74 |
| 3,756,598 | 9/1973 | Maeda . | |
| 3,796,865 | 3/1974 | Kashio . | |
| 4,143,874 | 3/1979 | McGehee | 473/72 |
| 4,265,449 | 5/1981 | Reiner | 473/74 |
| 4,283,049 | 8/1981 | Karlin . | |
| 5,096,192 | 3/1992 | Standford . | |
| 5,171,012 | 12/1992 | Dooley . | |

*Primary Examiner*—Sebastino Passaniti

*Attorney, Agent, or Firm*—Tyrone Davis; John S. Kendall

[57] ABSTRACT

A miniature bowling alley game comprising a lane surface adjusted to such a height where at one end an individual could comfortably roll a miniature bowling ball towards the other end which contains a plurality of lamps backlighting a translucent panel which represents bowling pins. The game features a microcontroller and sensors which detect the speed and angle of the bowling ball as it enters the area of the pins; actual sound of the pins falling; an information panel; and more than 50 spares that can be set up for practice bowling.

11 Claims, 18 Drawing Sheets

LOCATION OF BALL DETECTORS

SENSOR ARRANGEMENT DIAGRAM 50 52 54

| BITS | 7 | 6 | 5 | | 4 | 3 | 2 | 1 | 0 | |
|---|---|---|---|---|---|---|---|---|---|---|
| PINS | DLY | OFF | ON | PINS | DLY | OFF | ON | -- | -- | BYTE |
| 1 | 0 | 0 | 0 | 2 | 0 | 1 | 0 | 0 | 0 | 8H |
| 3 | 0 | 0 | 0 | 4 | 0 | 1 | 0 | 0 | 0 | 8H |
| 5 | 0 | 1 | 0 | 6 | 0 | 0 | 0 | 0 | 0 | 40H |
| 7 | 0 | 0 | 0 | 8 | 0 | 1 | 0 | 0 | 0 | 8H |
| 9 | 0 | 1 | 0 | 10 | 0 | 0 | 0 | 0 | 0 | 40H |

SPARE 11 PIN CHART 56 58

| BITS | 7 | 6 | 5 | 4 | 3 | 2 | 1 | 0 | BYTE | CPL |
|---|---|---|---|---|---|---|---|---|---|---|
| PINS | 1 | 2 | 3 | 4 | 5 | 6 | 7 | 8 | | |
| VAL | 1 | 0 | 1 | 0 | 0 | 1 | 1 | 0 | A6H | 59H |
| PINS | 9 | 10 | | | | | | | | |
| VAL | 0 | 1 | 0 | 0 | 0 | 0 | 0 | 0 | 40H | BFH |

SPARE 11 SCORE CHART 60 62

59

| BITS | 7 | 6 | 5 | | 4 | 3 | 2 | 1 | 0 | |
|---|---|---|---|---|---|---|---|---|---|---|
| PINS | DLY | OFF | ON | PINS | DLY | OFF | ON | -- | -- | BYTE |
| 1 | 0 | 0 | 0 | 2 | 0 | 0 | 0 | 0 | 0 | 0H |
| 3 | 0 | 1 | 0 | 4 | 0 | 1 | 0 | 0 | 0 | 48h |
| 5 | 0 | 1 | 0 | 6 | 0 | 1 | 0 | 0 | 0 | 48H |
| 7 | 0 | 0 | 0 | 8 | 0 | 0 | 0 | 0 | 0 | 0H |
| 9 | 0 | 1 | 0 | 10 | 0 | 1 | 0 | 0 | 0 | 48H |

61 SPARE 32 PIN CHART 63

FIG. 6

64 66

| BITS | 7 | 6 | 5 | 4 | 3 | 2 | 1 | 0 | BYTE | CPL |
|---|---|---|---|---|---|---|---|---|---|---|
| PINS | 1 | 2 | 3 | 4 | 5 | 6 | 7 | 8 | | |
| VAL | 0 | 0 | 1 | 1 | 1 | 1 | 0 | 0 | C3H | 3CH |
| PINS | 9 | 10 | | | | | | | | |
| VAL | 0 | 0 | 0 | 0 | 0 | 0 | 0 | 0 | 00H | FFH |

SPARE 32 SCORE CHART 68 70

FIG. 6A 72 74

| BITS | 7 | 6 | 5 | 4 | 3 | 2 | 1 | 0 | BYTE |
|---|---|---|---|---|---|---|---|---|---|
| PINS | 1 | 2 | 3 | 4 | 5 | 6 | 7 | 8 | |
| VAL | 0 | 0 | 1 | 0 | 0 | 1 | 0 | 0 | 24H |
| PINS | 9 | 10 | | | | | | | |
| VAL | 0 | 1 | 0 | 0 | 0 | 0 | 0 | 0 | 40H |

76 SECOND BALL PIN COUNT SCORE CHART

FIG. 6B

MAIN ROUTINE

113
START NEW FRAME
114
CLEAR GUTTER FLAG
115
CLEAR PIN COUNT WINDOW
116
NEXT BOWLER UP ?
YES
NO
117
NEXT BOWLER SUBROUTINE
118
ADVANCE FRAME COUNT
119
TURN PINS ON
120
START FRAME SET TIME DELAY
177
121
POLL FOUL LINE 2 INPUT
132
133
122
IS BALL DETECTED ?
NO
125
YES
123
POLL FOUL LINE 1 INPUT

136
SAVE FIRST ROW SENSOR POSITION
137
POLL BACK ROW SENSORS
138
BALL DETECTED ?
YES
NO
139
INCREMENT SPEED COUNTER
140
INCREMENT MIXER2
141
MIXER2 COUNT = 10
NO
YES
142
SET MIXER2 = ZERO
143
SAVE BACK ROW SENSOR POSITION
144
CONVERT SPEED TO PIN DELAY COUNT
145
RETRIEVE FIRST ROW SENSOR POSITION
146
FIRST BALL SENSOR = 1 ?
YES
147
SENSOR = 1 SUBROUTINE
NO
148
FIRST BALL SENSOR = 2 ?
YES
149
SENSOR = 2 SUBROUTINE
NO

162
GET SPARE 17 PIN KNOCKDOWN DATA
163
IS THIS SECOND BALL ?
YES
SECOND BALL DATA ROUTINE
NO
164
GET SPARE SP17 PIN COUNT
165
CALL PIN KNOCK DOWN ROUTINE
166
SPARE 17 EXECUTION SUBROUTINE
167
OUTPUT PIN COUNT TO DISPLAY
168
SAVE COUNT IN COUNT REGISTER
169
SET SECOND BALL FLAG
170
CALL FIRST BALL SCORE SUBROUTINE
171
RETURN FOR SECOND BALL
120
172
120-145 REPEATED SPARE 63A SELECTED
173
GET SPARE 63A PIN KNOCKDOWN DATA

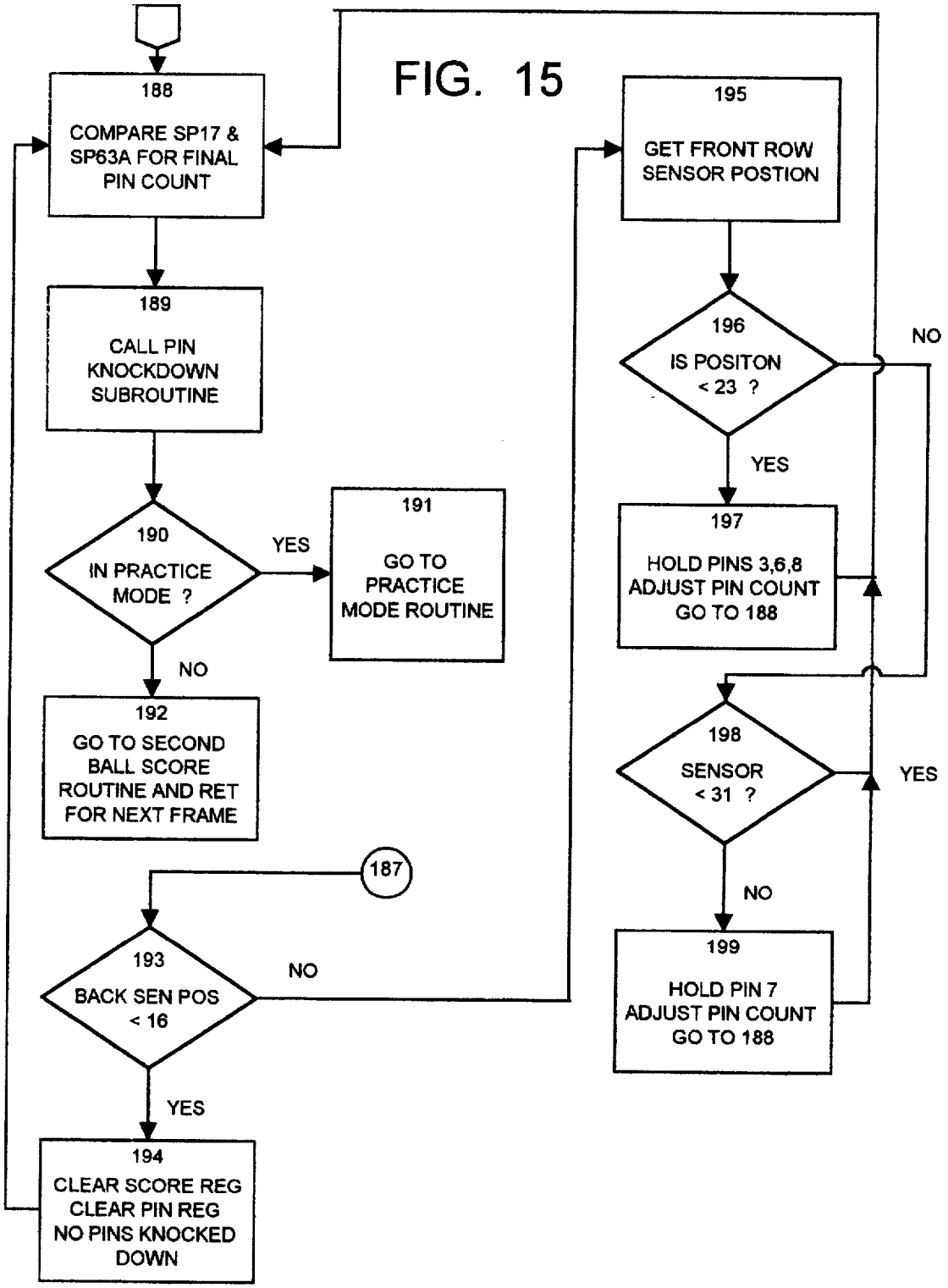
FIG. 15
188
COMPARE SP17 & SP63A FOR FINAL PIN COUNT
189
CALL PIN KNOCKDOWN SUBROUTINE
190
IN PRACTICE MODE ?
YES
191
GO TO PRACTICE MODE ROUTINE
NO
192
GO TO SECOND BALL SCORE ROUTINE AND RET FOR NEXT FRAME
187
193
BACK SEN POS < 16
NO
YES
194
CLEAR SCORE REG CLEAR PIN REG NO PINS KNOCKED DOWN
195
GET FRONT ROW SENSOR POSTION
196
IS POSITON < 23 ?
NO
YES
197
HOLD PINS 3,6,8 ADJUST PIN COUNT GO TO 188
198
SENSOR < 31 ?
YES
NO
199
HOLD PIN 7 ADJUST PIN COUNT GO TO 188

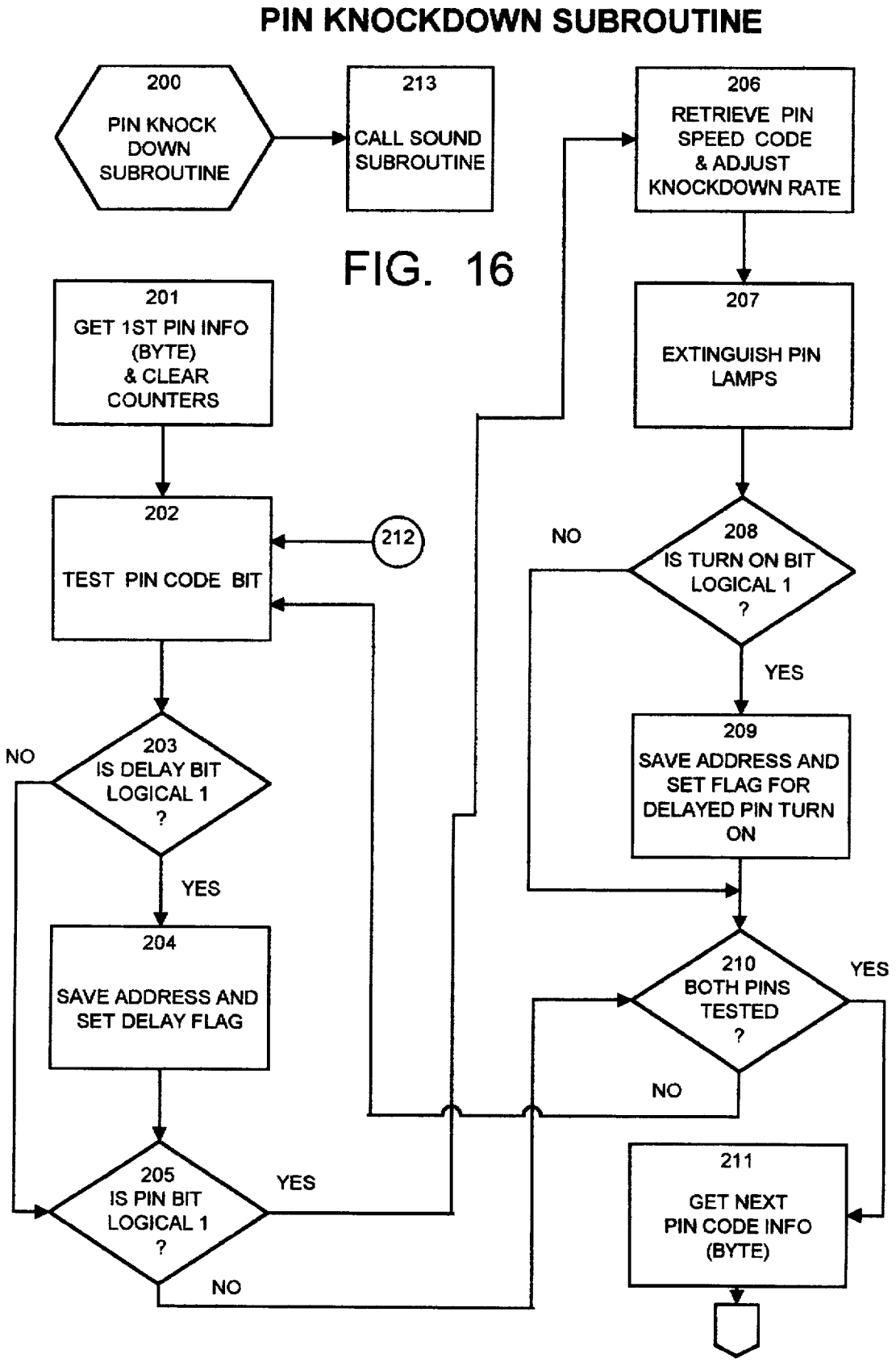
PIN KNOCKDOWN SUBROUTINE
200
PIN KNOCK DOWN SUBROUTINE
213
CALL SOUND SUBROUTINE
206
RETRIEVE PIN SPEED CODE & ADJUST KNOCKDOWN RATE
FIG. 16
201
GET 1ST PIN INFO (BYTE) & CLEAR COUNTERS
207
EXTINGUISH PIN LAMPS
202
TEST PIN CODE BIT
212
NO
208
IS TURN ON BIT LOGICAL 1 ?
YES
209
SAVE ADDRESS AND SET FLAG FOR DELAYED PIN TURN ON
NO
203
IS DELAY BIT LOGICAL 1 ?
YES
204
SAVE ADDRESS AND SET DELAY FLAG
210
BOTH PINS TESTED ?
YES
NO
205
IS PIN BIT LOGICAL 1 ?
YES
NO
211
GET NEXT PIN CODE INFO (BYTE)

MINIATURE BOWLING ALLEY GAME

BACKGROUND OF THE INVENTION

This invention relates to amusement devices and to an improved simulated bowling game. More particularly to a novel bowling game having a size, height, and sound which perfectly simulates an actual game of bowling. A bowling game having the ability to allow play for up to four participants, and simulated in such a way as to allow a participant to bowl his/her standard average. The bowling game has flat rectangular shape and elevated table that is approximately 24 inches high and approximately 17 inches wide. The ball is approximately 2 inches in diameter. The approach area is approximately 15 feet long and approximately 17 inches wide. The alley area is approximately 72 inches long and 13 inches wide with gutter areas on each side that is approximately 2 inches wide. A pin display area is positioned at an angle of approximately 70 degrees with respect to the alley area. The present invention is designed to be placed conveniently in a recreation room, bar, or office without obstruction.

Heretofore most bowling games used some sort of mechanical or electro mechanical apparatus at one end of a bowling alley to eject the ball to the other end where miniature bowling pins are "knocked down". Those inventions required the use of complicated mechanisms to relocate the pins on the alley surface or the pins would be relocated by hand. In addition, they lacked the means to determine the endless pin combinations experienced by participants in real bowling and simulated bowling experiences. Many of these games used mechanically propelled bowling balls and lacked the skill factor inherent in the actual game of bowling. Certain of the patents viewed that characterize the above are listed below.

The game as disclosed by Koci, U.S. Pat. No. 2,643,884, allowed Jun. 30, 1953 shows a pinball type bowling game. The game uses a puck that is slid across the alley and engages suspended end fingers. There is enough clearance between the pins and switches for the puck to slide underneath. When the puck contacts the finger certain pins fold up. Thus, causing an electro mechanical operation of the game for pin knockdown and scoring. Maeda U.S. Pat. No. 3,756,598, allowed Sep. 4, 1973, shows another table top bowling game. This one uses a miniature man to propel a marble sized ball down the alley and knockdown a ten pin setup. In addition, it has an electro mechanical setup arrangement. Standford et al. U.S. Pat. No. 5,096, 193 discloses a table top game having a release ramp for rolling the ball down the lane. It further discloses an alley having a trough which guides the ball down the center of the alley.

Electronic and video games have provided a simulated game having simulated display as well as sounds. The game as disclosed in Karlin et al. U.S. Pat. No. 4,283,049, allowed on Aug. 11, 1981, shows a table top electronic bowling game which operates with a ball that strikes operating contacts and simulates the knocking down of pins. It also maintains scores and randomly providing a different score even if the ball rolls down the same lane. The obvious limitations in this game is that it does not provide a true simulation of a real game. It also lacks the visual stimulation of a real game. Dooley, in U.S. Pat. No. 5,171,013 discloses a video bowling game which uses a ball which is propelled down the lane and infrared emitters and detectors are intermittently dispersed so as to detect the ball and correspondingly display a pin knockdown arrangement. Dooley also contemplates the use of a full sized bowling ball on a shortened alley. The game as disclosed in Dooley cannot accurately simulate the game of bowling that will provide the participant the challenge to his/her standard average.

Therefore, it is a principal object of the present invention to provide a miniature simulated bowling game and provide an interactive means for a number of participants.

Another object of the invention is to provide a simulated bowling experience where a participant's bowling average will correlate with that achieved with the present invention.

An object of the invention is to provide a simulated bowling experience where the sound and display corresponds to the velocity and position of the ball as in a real game.

An object of the invention is to provide a simulated bowling game where the position, velocity, and curvature of hook on the ball creates spare combinations similar to a real game.

Yet another object of this invention is to allow participation by the disabled and handicapped without having them to be limited by their physical limitations.

Finally, it is an object of this invention to provide a simulated bowling game that provides an individual the experience similar to a real game in their home or office.

These and other objects of the present invention will become apparent and will be more fully understood upon reading the following specification and referring to the accompanying drawings, which form a material part of this disclosure.

SUMMARY OF THE INVENTION

The inventor has overcome the problems which has prohibited the prior simulated games from providing an experience similar to a real game. The inventor has overcome the limitations of the other games by developing a detection arrangement which accurately detects the velocity, position, and curvature of the ball and is able to determine strike and spare combinations. In addition, the invention provides sound effects based upon these criteria so that a participant would experience the sounds of the exact spare or strike combination in a real game. The invention has the ability to provide practice sessions where the participant can select from over 50 spare combinations. Moreover the present invention has a feature which determines the exact placement of the ball that allows for difficult spare combinations to be made.

BRIEF DESCRIPTION OF THE DRAWINGS

Figure shows the miniature bowling game;

FIG. 6 is the pin chart for spare combination 32;

FIG. 6A is the score chart for spare combination 32;

FIG. 6B is the second ball pin count score chart;

FIGS. 8–15 is the block diagram for the main program sequence;

FIGS. 16–17 is the block diagram for the pin knockdown subroutine; and

THE PRESENT INVENTION

Figure 1:
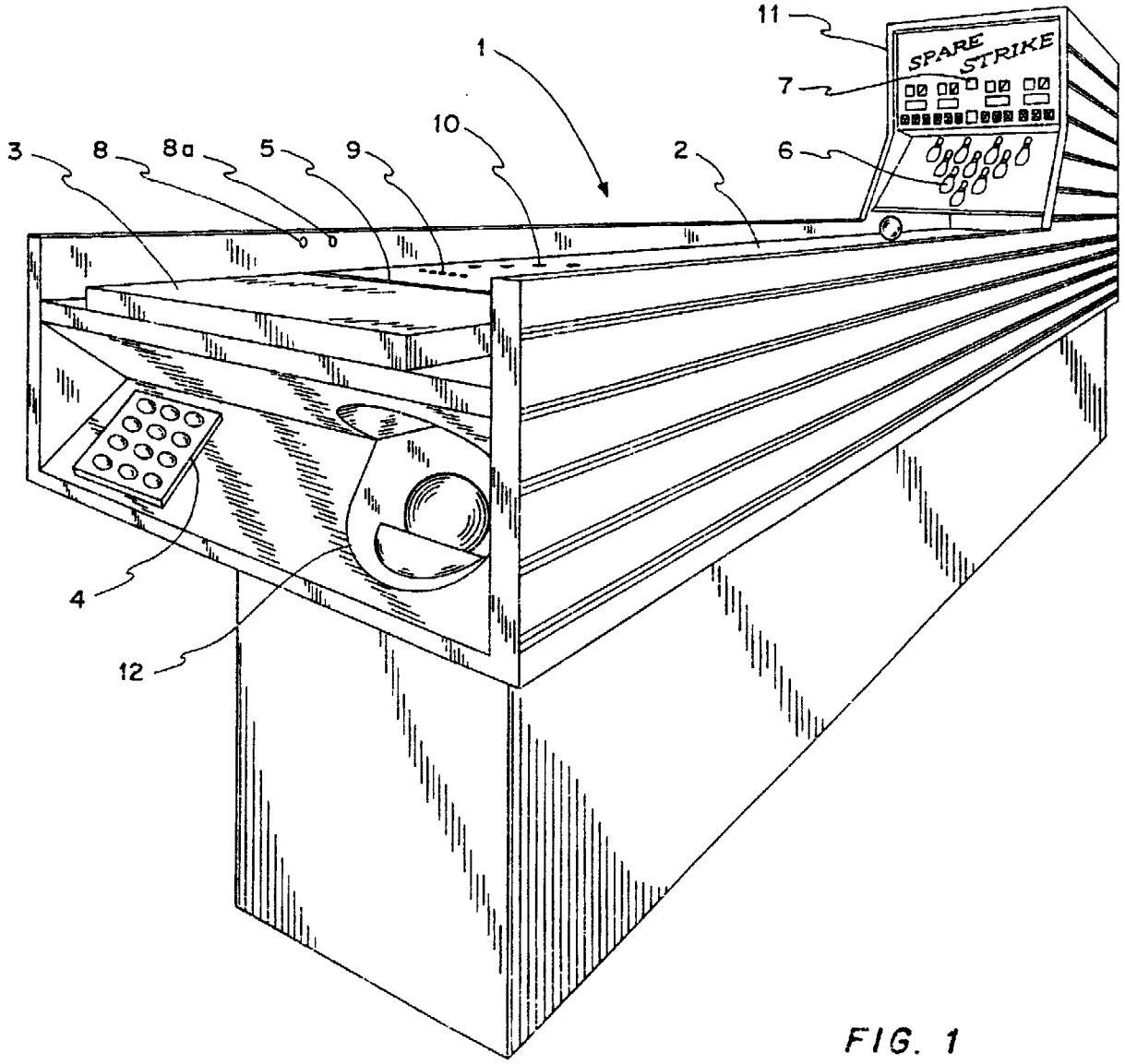
Figure 2:
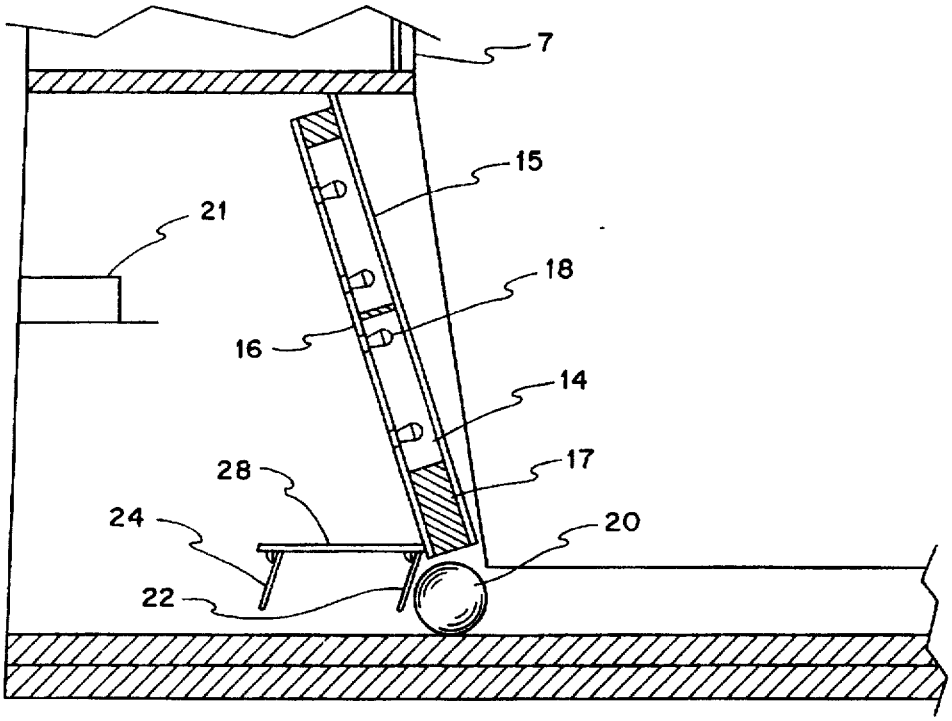
FIG. 2 shows a sectional view of the miniature bowling game taken at the display panel.
Figure 3:
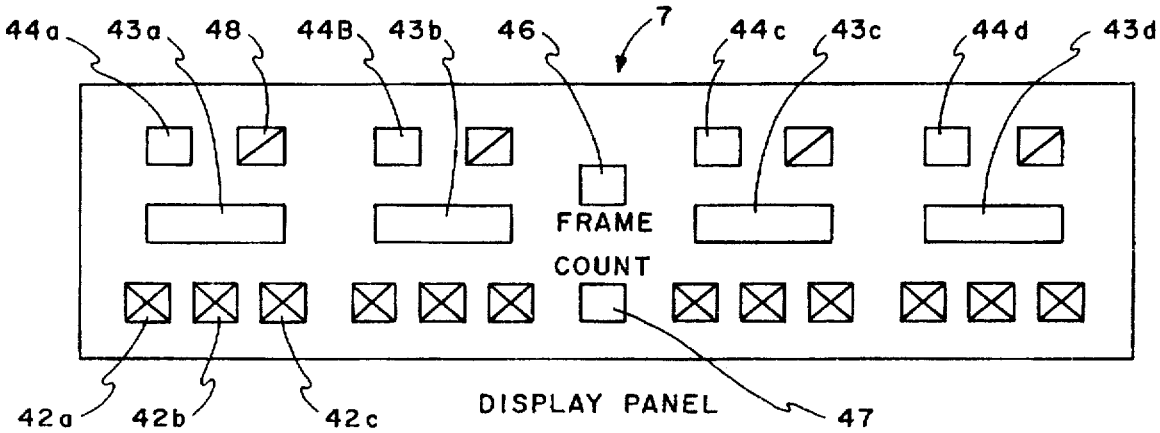
FIG. 3 is a detail of the information area.

In FIG. 1, a bowling game 1 of the present invention includes an elevated table T. The table T is elevated on a pedestal P and table T defines an alley (2) separating a front end (3) and a back end (11). The front end (3) contains a keypad (4), a ball return area (12), and including a foul line (5). Two infrared foul line sensors (8 and 8*a*) located in the alley (2), along with locator dots (9) and target arrows (10). The back end (11) include a pin display area (6) and an information area (7). The pin display area (6) comprises a translucent panel (15), masked from the rear (14) to depict ten bowling pins. The panel (15) is adhered to a lamp shield (17) which itself is affixed to a printed circuit panel (16). This holds twenty lamps (13), two lamps for each bowling pin. This entire assembly is mounted at an angle approximately 70 degrees with respect to the alley (2) and is elevated approximately two and one-eighth inches above the alley to allow ball (20) to pass underneath. When all lamps (13) are extinguished the panel (15) appears gold in color. And no simulated bowling pins appear. However, when the lamps (13) are lighted, the ten simulated bowling pins appear prominently against the gold background of panel (15). A sensor unit (23) includes a front row of 50 sensors (22), oriented immediately behind the printed circuit panel (16) and display panel (15) and numbered consecutively from 1–50. A second row of 50 consecutively numbered sensors (24) are positioned approximately four inches to the rear of the first row.

An information display panel (7) is located directly above the gold display panel (15). Providing a separate section for up to four bowlers. Each section includes a "bowler up" indicator (44*a–d*), that is lighted to indicate the turn of each bowler; a spare indicator (48) which when lighted indicates that the bowler made a spare during the previous frame. A three-digit seven segment LED display (43*a–d*) that displays each players true score as if in a real game of bowling. Strike count indicators (42*a–c*), which when illuminated will display a bowler's strikes accumulated for three consecutive frames. The information display panel (7) will continue to hold three strikes as long as the bowler continues to score strikes or the tenth frame is finished. In the center of the information display area (7) is pins "knocked down" (46). After the first ball is rolled the total pins "knocked down" after the second ball is displayed.

Figures 4, 5, 5A:
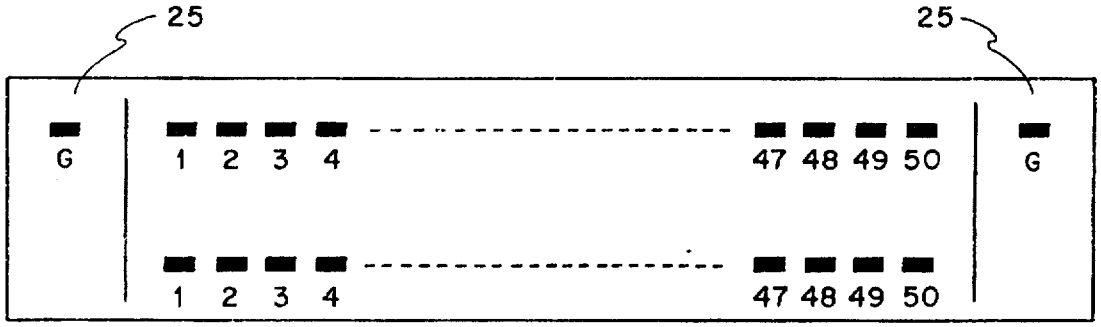
FIG. 4 shows the sensor arrangement.
FIG. 5 is a pin chart for spare combination 11.
FIG. 5A is the score chart for spare combination 11.
Figure 7B:
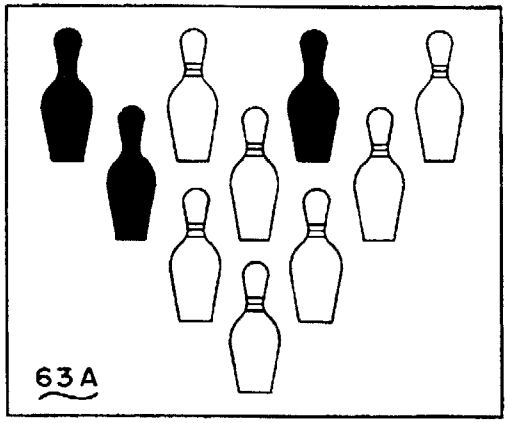
FIG. 7B shows the pin chart for spare combination 63*a;*
Figure 7C:
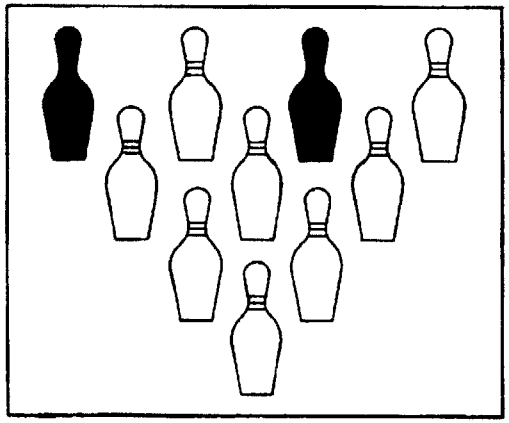
FIG. 7C shows an analysis chart of the combination of spare combination 17, and 63*a;*
Figure 7A:
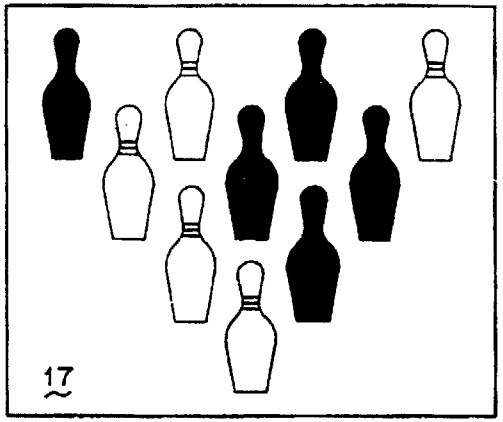
FIG. 7A shows the pin chart for spare combination 17.
Figure 8:
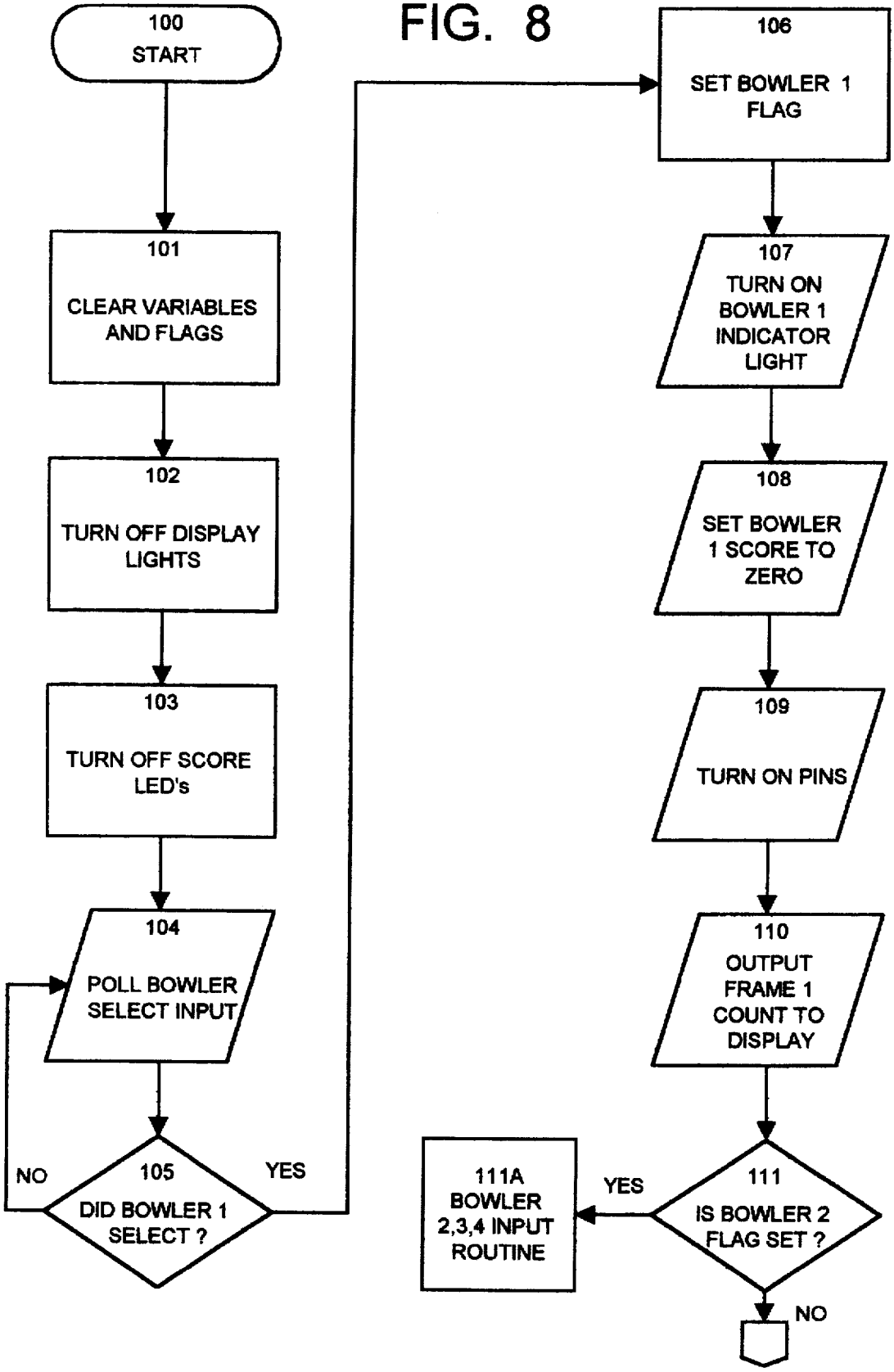
Figure 9:
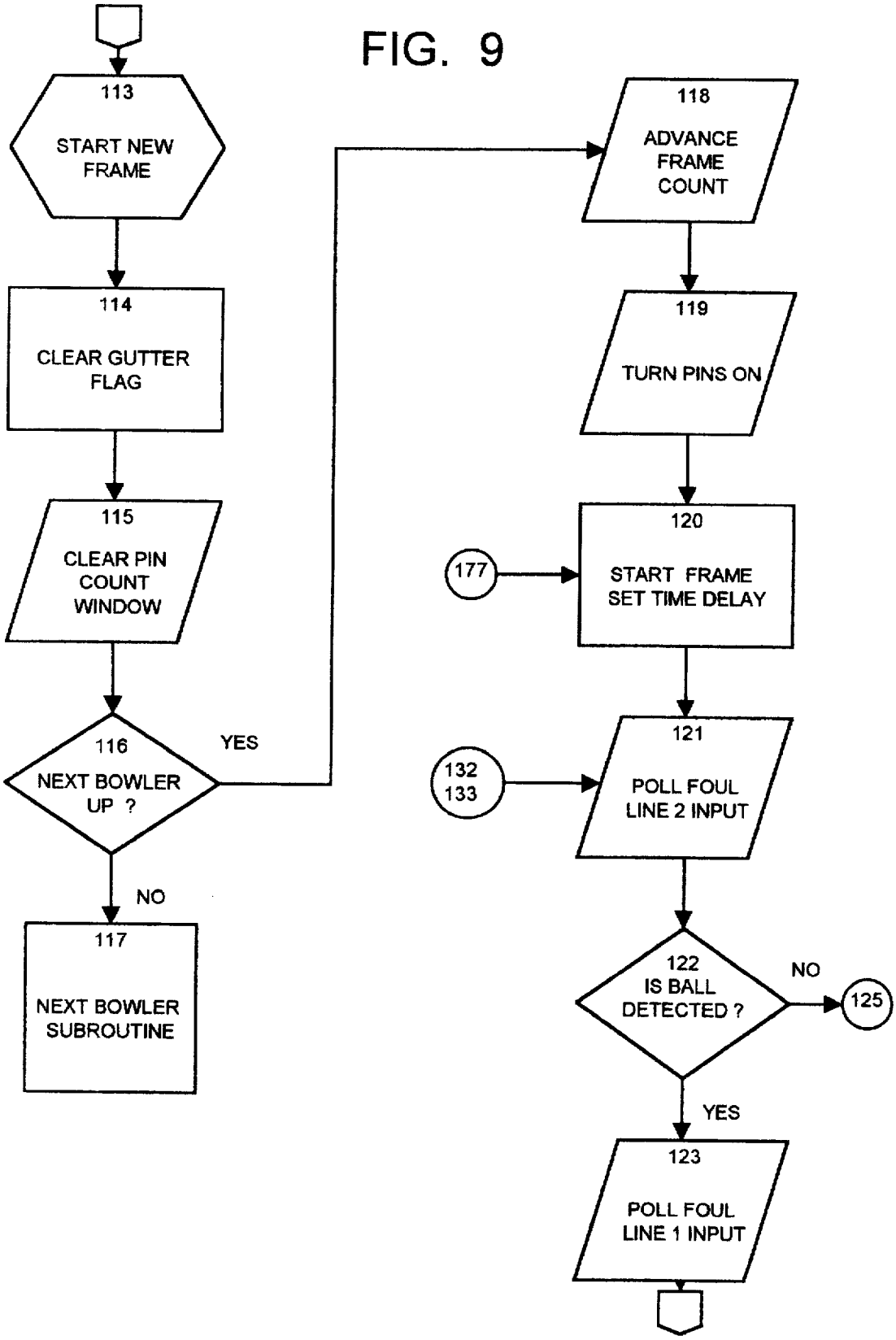
Figure 10:
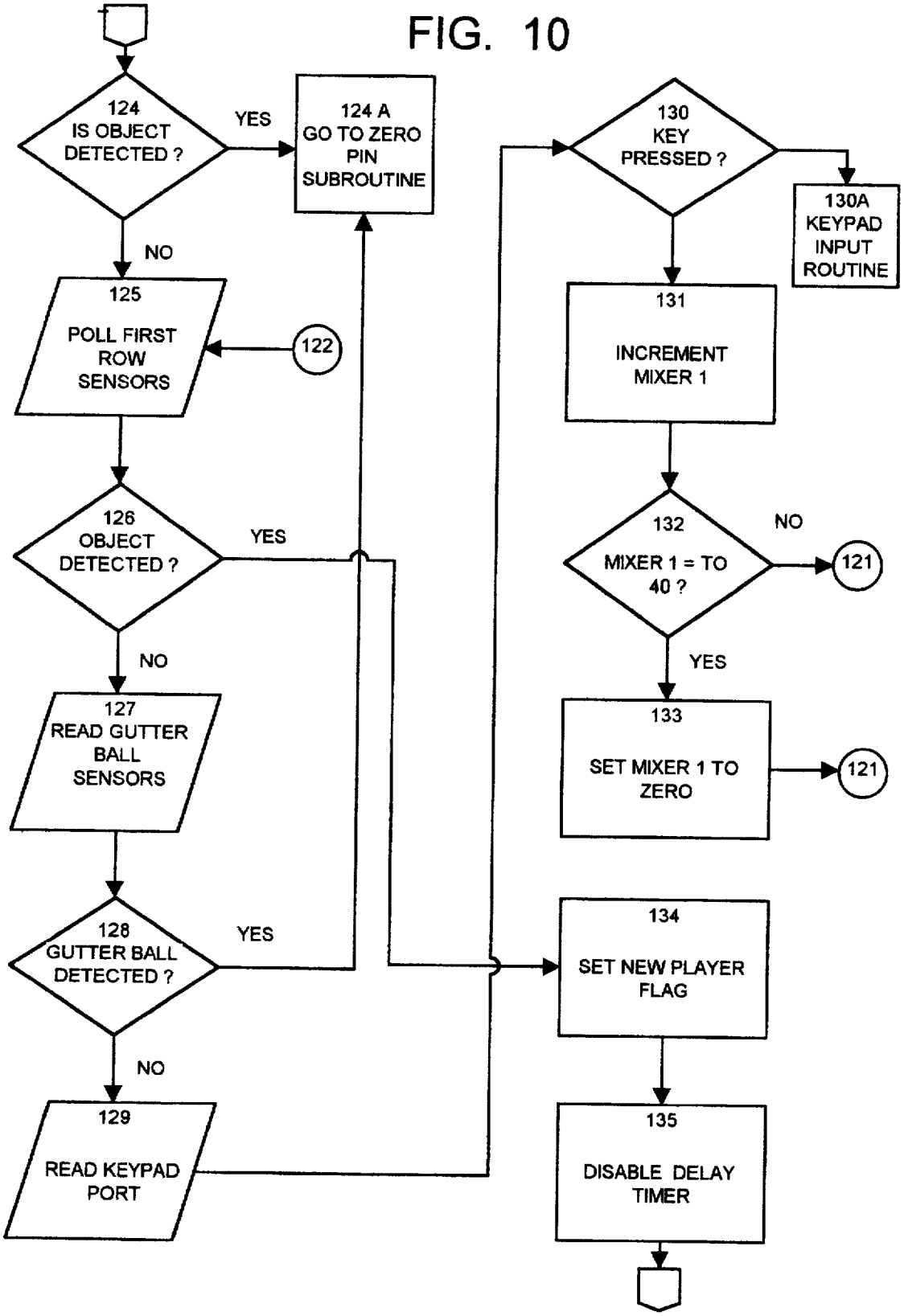
Figure 11:
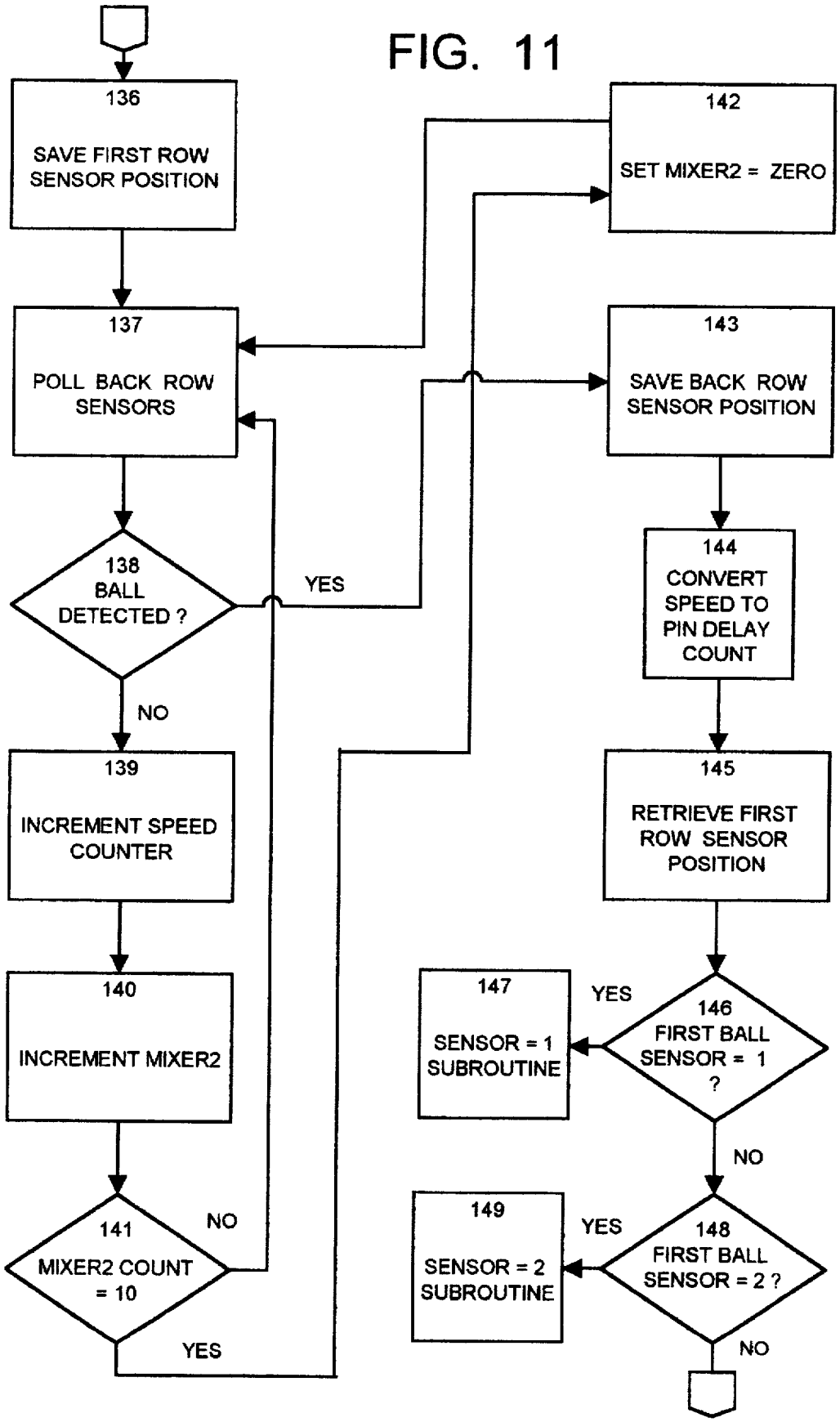
Figure 12:
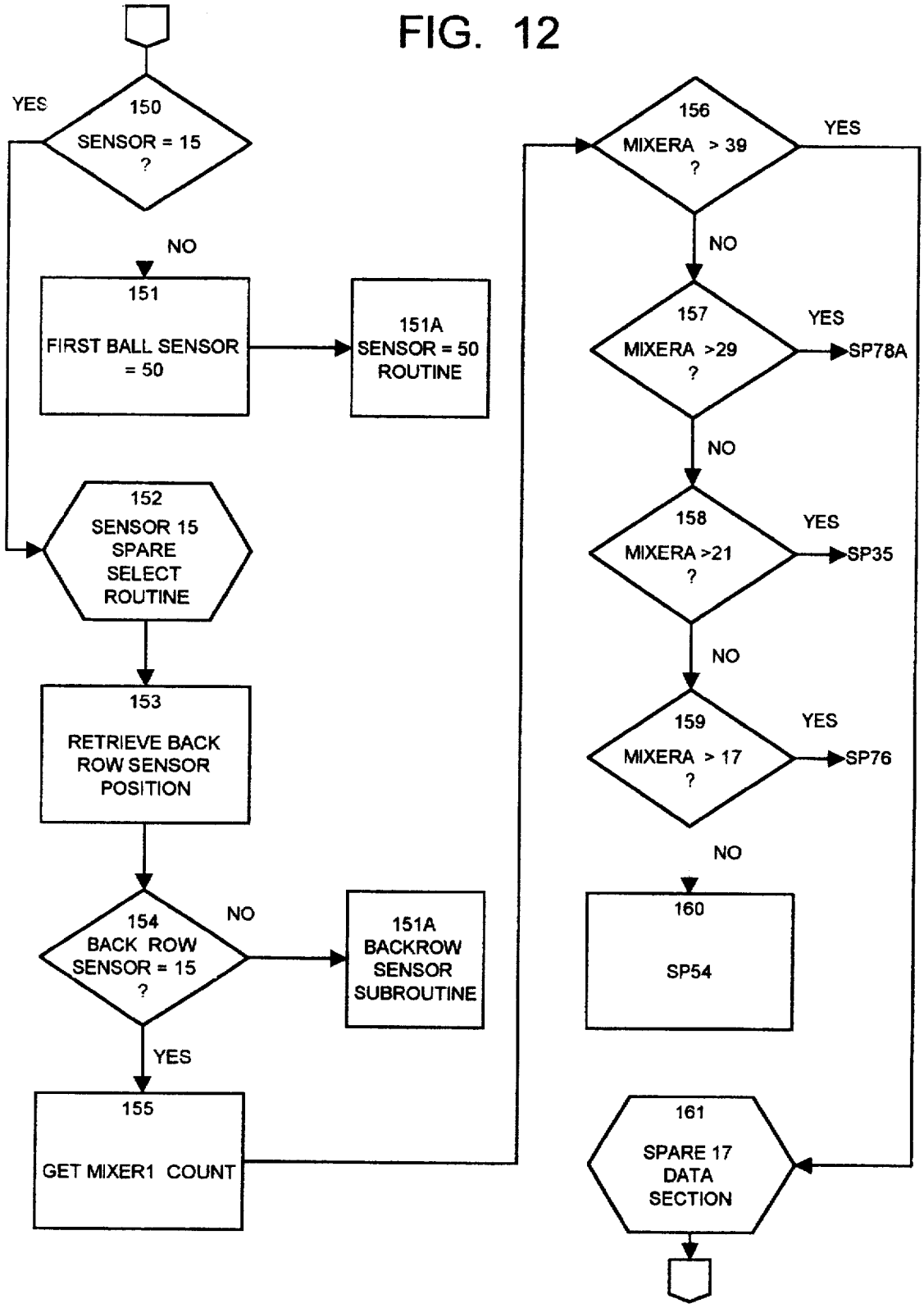
Figure 13:
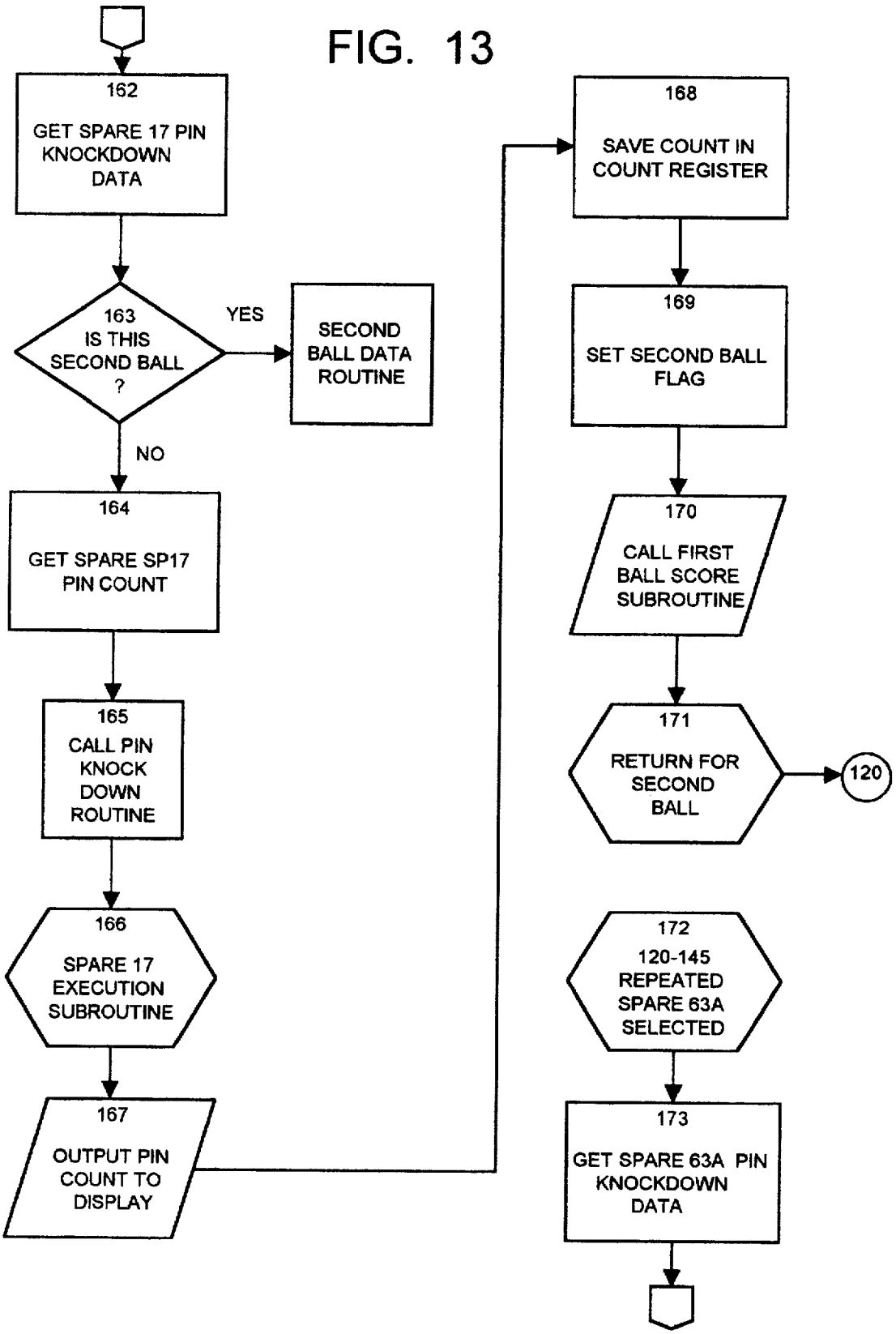
Figure 14:
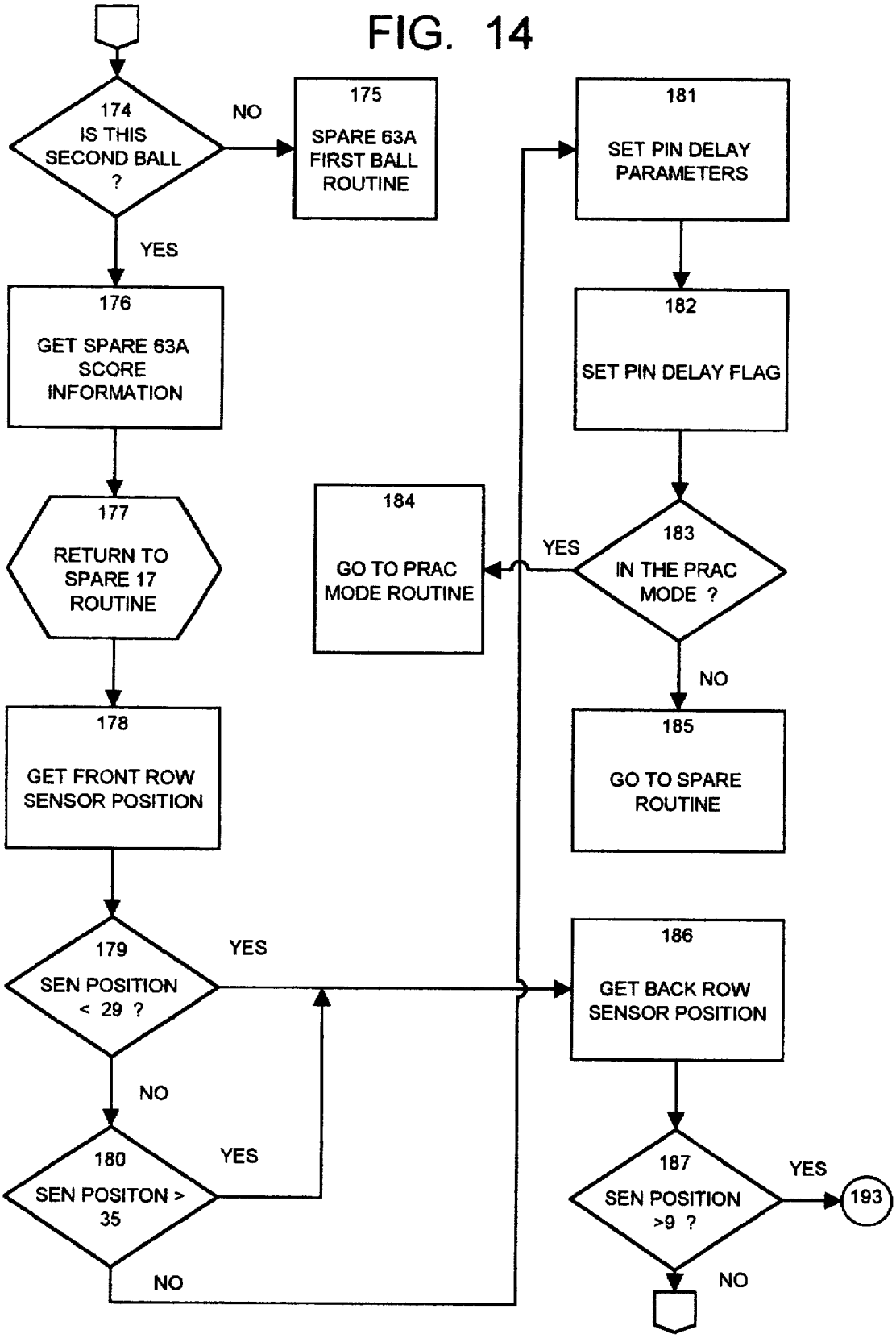
Figure 17:
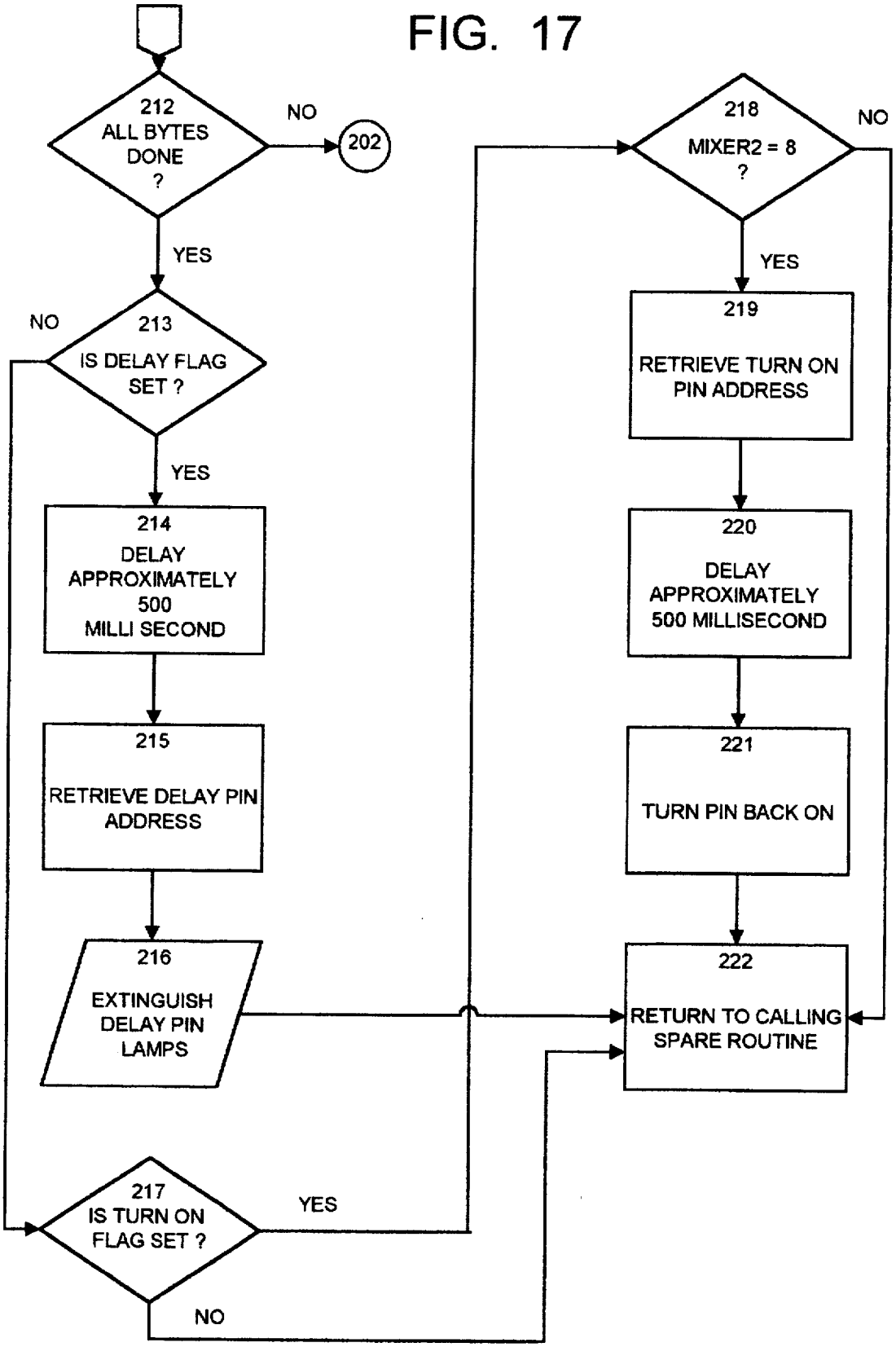
Figure 18:
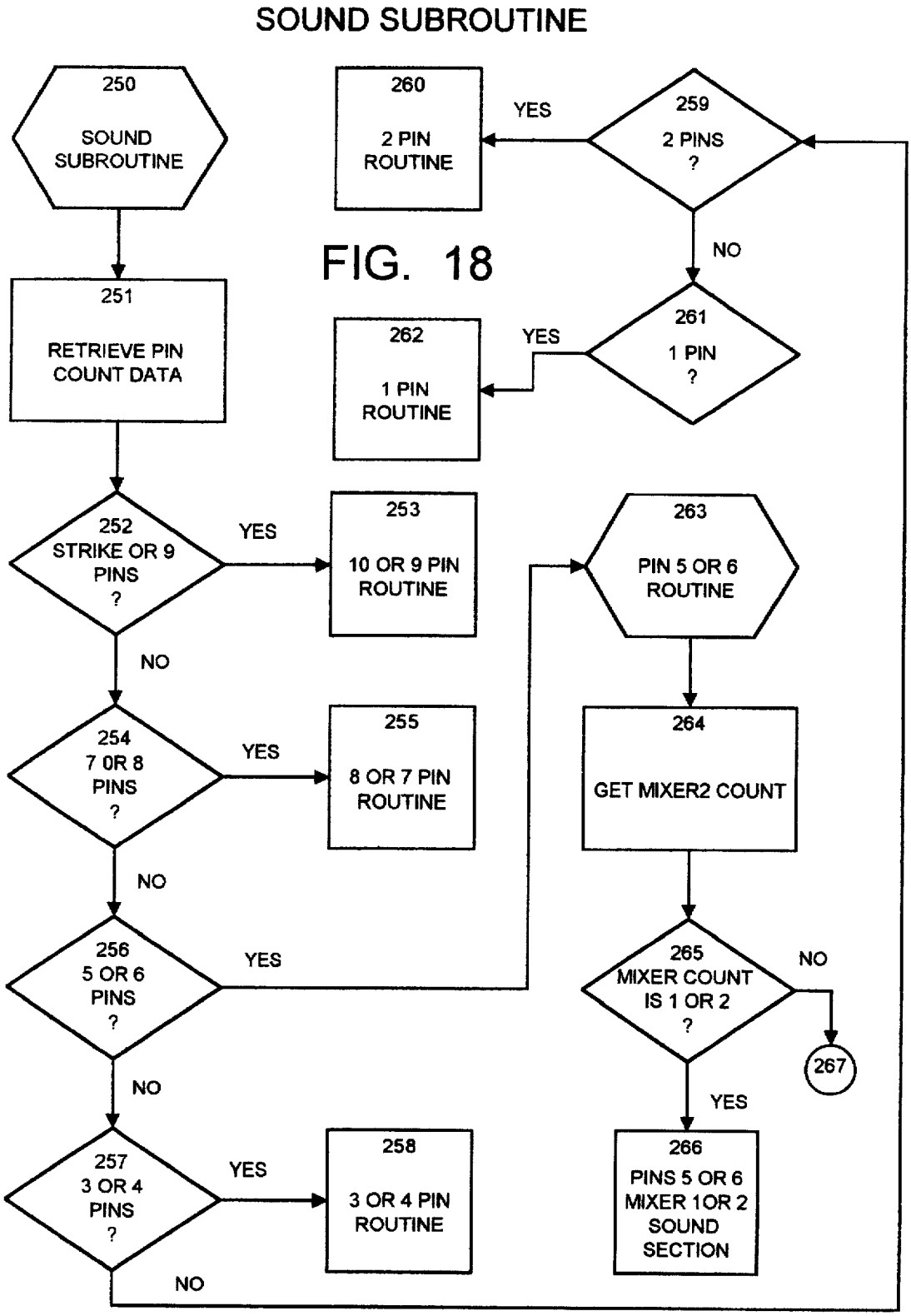
FIGS. 18–20 is the block diagram for the pin sound effect subroutine.
Figure 19:
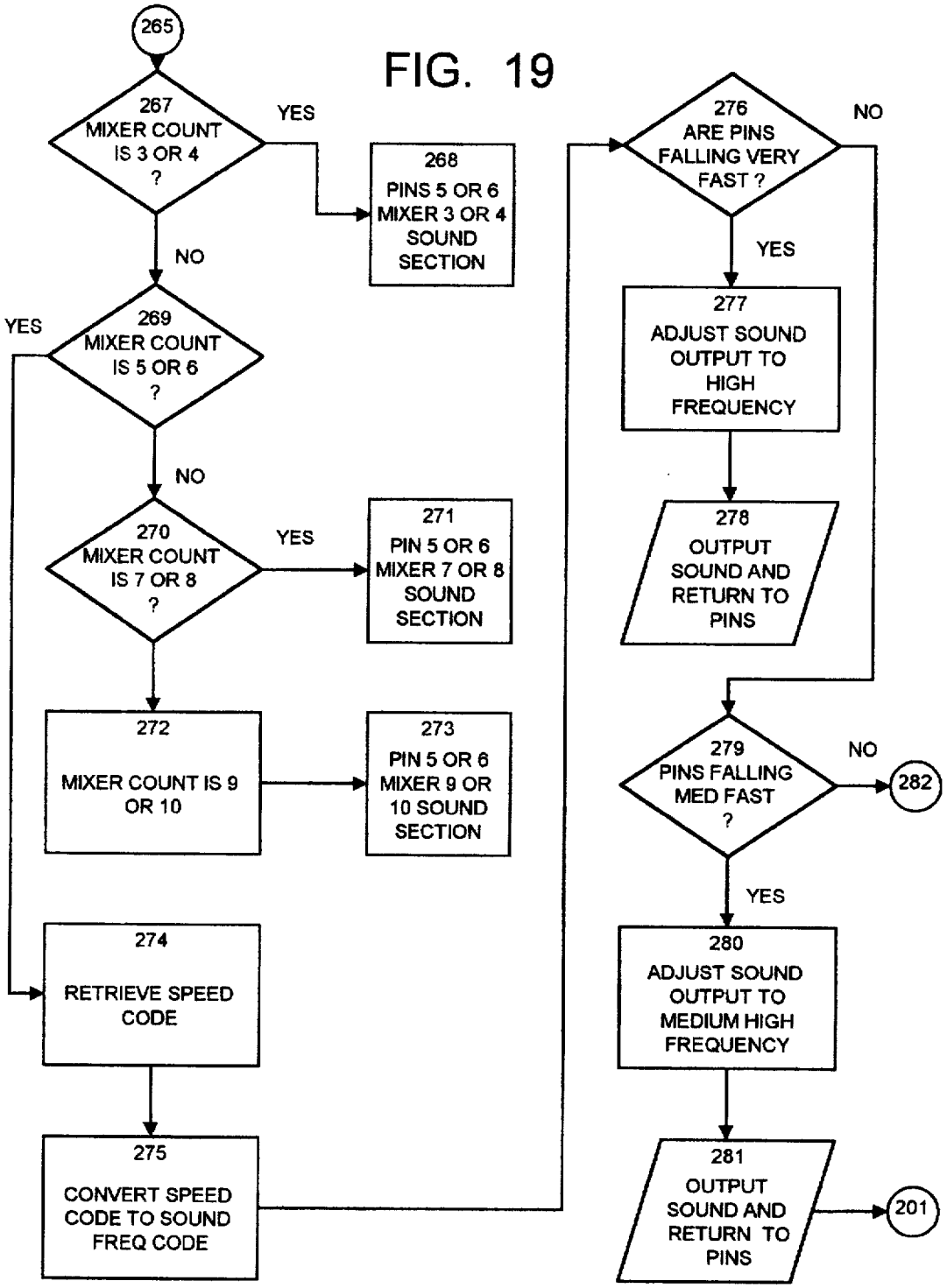
Figure 20:
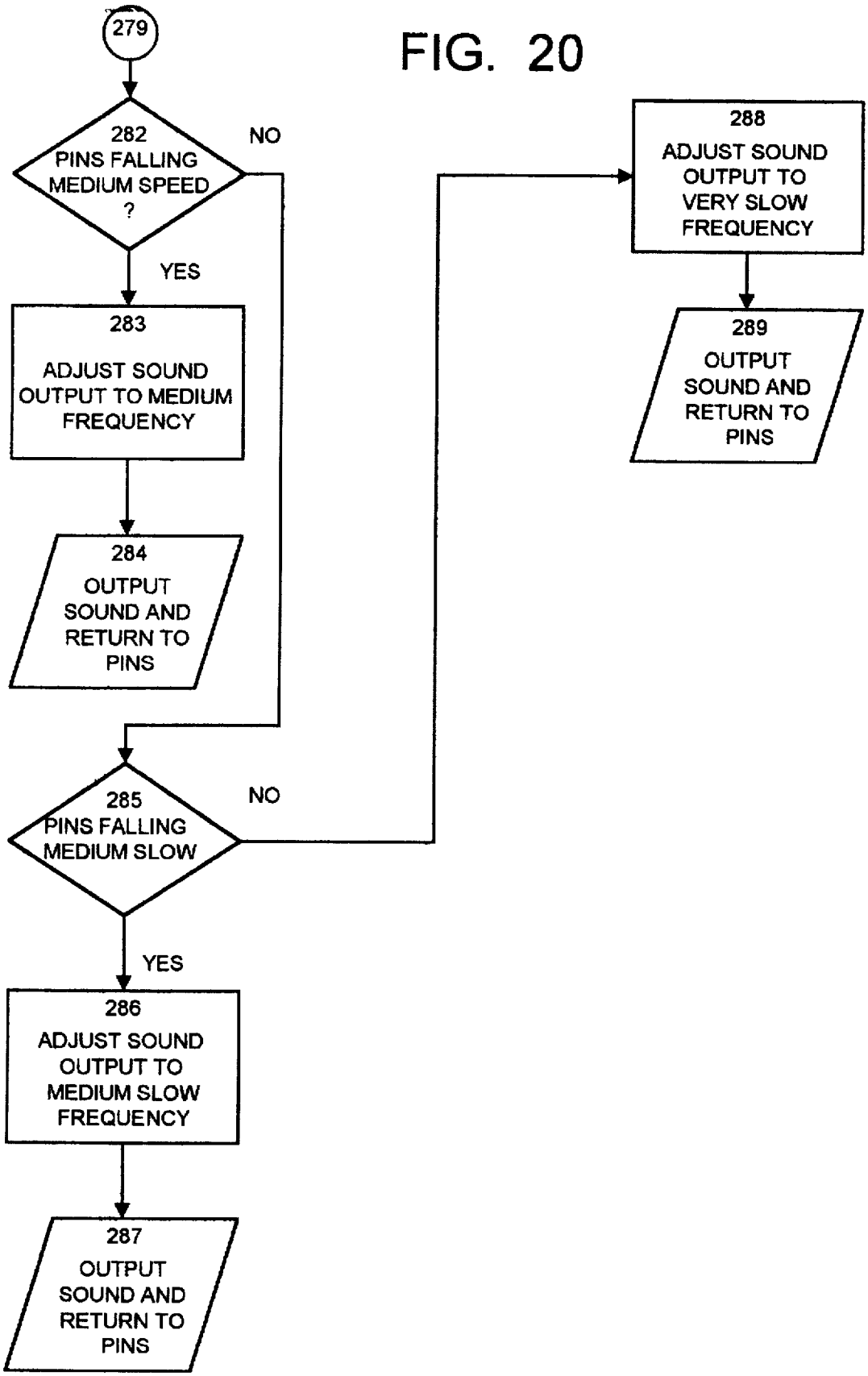

FIG. 5 shows that for spare combination 11, pins 2,4,5,8, and 9 will be "knocked down" since each of their "off" bits is a logical "1," and are represented by the byte values of 8H, 8H, 40H, 8H and 40H. FIG. 5A shows the score chart for spare combination 1. This charts consist of two bytes of information. The first bye represents pins 1–8, and the second byte represent pins 9 and 10. A bit value of "0" indicates that the pin has been "knocked down." FIG. 5A shows that for spare combination 11, pins 2,4,5,8, and 9 are to be "knocked down" and are represented by the byte values of A6H AND 40H FIG. 6 is the reference chart for a spare combination 32. It indicates the pin number (59), which pins are activated (61), and if a delay was triggered (63). FIG. 6A shows the "pin count" bytes C3H (64) and 00H (68) and their complements'. Pin count bytes 3CH (66) and FFH (70) for spare combination 32 are shown. FIG. 5A shows the pin count bytes A6H (56) and 40H (60) and their complements' 59H (58) and BFH (62) for spare combination 11. The pins "knocked down" on the first ball "spare combination 11" are pins 2,4,5,8 and 9 as represented by the logical "0" in the bytes A6H and 40H respectively. To determine the total pins knocked down" after the second ball, "spare combination 32," the bytes A6H and 40H of the first ball are logically "AND" with 3CH and FFH of the second ball. The pin count total for the first and second ball spares are determined by logically "ANDing" the first ball pin count bytes with the "complement" of the second ball count bytes. When A6H is "AND" with 3CH and FFH is "AND" with 40H the results are 24H and 40H respectively. FIG. 6B shows that these bytes cause the bits for pin 3 (72), pin 6 (74) and pin 10 (76) to be logical "1's". These are the additional pins that must be added to the count of the first ball to get the total pin count for the frame.

The invention operates in accordance with a software program control sequence embedded in the memory of a microcontroller (21) consisting of an 8031 microcontroller microchip with an associated EPROM. The program sequence includes the following: players are selected; foul line is tested; the first ball is bowled; the front and backrow sensors are polled; an activated sensor is detected on the front row; an activated backrow sensor is detected; the velocity of the ball is calculated; the spare routine is computed based upon a random mixer number; spare selection is flashed on the display based upon the velocity of the ball; and the score is updated and ball returns for next bowl. As the second ball is bowled the routine is the same however after the random mixer number is selected, the spare selection is made and the two spare combinations are compared to determine which pins where knocked down for the frame and the score is updated. Finally, the ball returns for the next frame.

The Preferred Embodiment

Referring to the flowcharts of FIGS. 8–15, the operation of an embodiment of the invention is described as it relates to the software program. In operation, a player presses the start button on the key pad (4) the program begins the start sequence (100–104). The program begins to poll the number of bowlers to play (104–111). The invention has the ability to keep an accurate game score for up to four bowlers for ten complete flames. At the start of the game, the program clears all the scores and windows while polling the foul line detectors (113–123). The foul line sequence constantly polls both the first and second detectors, if the second detector (8*a*) is activated then it polls simultaneously the first detector (8), and if the first detector (8) is activated then a foul has occurred. The program enters the foul line subroutine and zeros out the pin score and advances to the next frame. If there is no detection (124) then the front row sensors (24) are polled for activation. If non are detected then the gutter ball detectors (127) are polled for activation. If front row detectors (22) are activated then the keypad is read (129). The key pad is read to see if the practice mode is selected. If the practice mode is not pressed, then the increment mixer (131–133) is read and the routine is executed. This increment mixer is read to allow for a more random selection of spare routine combinations. The increment mixer randomly selects a number from 1 to 40. The front row sensor position is saved and the poll of the second row sensors (24) is obtained. Once the front sensor activation is detected the increment speed counter (139) activates and continues to count until the second row detector is activated. The second row sensor position is saved (143) and the speed increment routine converts a pin count delay (144). The first row position is retrieved and an analysis of position is conducted based upon a normal set of sensor combinations. The program conducts an analysis based upon the normal curvature or hook of a ball. More specifically, the program is set to poll a certain set of sensors on the second row (24) based upon the position of the first sensor position. For example, if the first sensor activated is number 15, (152) then the program retrives the back row postion (153) By using limiting factors, rather than polling the numbers beginning at 1 the program automatically looks at the corresponding back row sensor beginning at 15. For example the program may look at sensors 9–14 on side and poll those sensors and then poll sensors 16–22 on the other for activation. Limiting the poll of back row sensors to a 10–12 sensor spread increases speed of the analysis. In addition, it also limits the number of possible spare combinations to consider. Blocks (152–160) determines the position of the back row sensor position in relation to the front row sensor. The program selects a spare combination based upon the random mixer count number (159). Once the program determines the spare combination it begins that spare combination subroutine. In the instant embodiment, spare routine 17 is selected. A querie is conducted to determine if this is the second ball (163). The pin count (164) and home position are determined. The pin knockdown subroutine (165) is initiated. The pin knockdown subroutine controls the pin knockdown sequence including a pin wobble effect and pin delay response.

Starting at block (200), sound subroutine (213) is activated. The pin information is retrieved for the first pin (201). (Refer to FIG. 5 for pin information) There are assigned two bits for each pin. The pin code bit is tested (202). The pin information is checked to see if the delay is set to 1 (203). If it is then that address is saved and delay flag is set (204). If not, then the pin information is checked to see if pin is set at 1. If it is then the pin speed knock down code is retrieved and all lights are extinguished (205–207). The pin information is checked for a 1 value for pin turn on. If yes then the address is saved and a delay flag is set (208, 209) A query is conducted to determine if both bits have been tested for the first pin. If they have, then the subroutine continues until all twenty pin bits have been tested (202–210). If all pin bits have been tested, then a sequence begins to review information set for each pin. If a delay flag is set for that pin a delay sequence (214–216) begins. Alternatively, in order to simulate a real bowling effect, if no delay flag is set, a random pin wobble may occurr (218–221). In the first sequence, if the delay flag is set a delay is applied of approximately 500 milliseconds. The pin address is retrieved (215), and the delay pin lights are extinguished (216). If the delay flag is not set, a mixer count is reteieved (218). This mixer issues a number from 1–10. A query begins to determine if the count number is 8. This provides that this sequence is activated once in every 10bowls. If the mixer count is equal to 8, then the turn on pin address is retrieved (219). A delay is set for approximately 500 milliseconds and then the pin lights are turned back on (221 ). Once this is done for all ten pins, it returns to the main program.

Simultaneously, the sound subroutine begins. This subroutine uses the ball speed and pin count total to determine which sound effect to apply. To insure that the participants experience a true lifelike activity, there is referenced 6 pin count combinations. Each of the six pin count combinations have five possible sound effect choices. Providing more than twenty-five sound effects for the game. Once the pin information is retrieved, a query is conducted (250–257). Six pin count combinations a predetermined. The pins are grouped as follows: a strike or 9 pins; 7 or 8 pins; 5 or 6 pins; 3 or 4 pins; 2 pins; and 1 pin. After the pin count is determined (256), the mixer count number is retrieved. Using the 10 count mixer (264), a query is conducted to randomly select the sound effect for that pin count. The speed code is converted and an analysis is done for sound output speed. Then the sound effect is applied (276–289). Once this is done, it returns to the main program.

After returning to the main program, the pin count is sent to the display (7). The pin count is saved (168, and the program resets for the second ball (171). Each spare combination subroutine has an associated home position routine. This controls the analysis of the first and second spare combination. After the second ball is rolled, the program initiates the new frame (120) and begins the game sequence (121–160). Beginning at block (173) the second ball spare combination is determined and pin knockdown data retrieved. The second ball querie is determined (174). The spare score information is retrieved (176). The program then initiate a routine which determines whether there is a spare pickup or a count of pin knockdown. After gathering the spare information, (spare routine 63*a* is selected ) the program returns to the first spare routine home position (17). Blocks (179–180) conducts an analysis of sensor activations based upon a predetermined set of parameters that allows the participant to pick up difficult spares. This information has been determined by surveying hundreds of frames and the exact position of the ball to pick up certain spare combinations. By applying limitors to the sensor readings of certain positions either on the front or back row (22, 24). For example block (179) queries if the sensor activation is less than 29. If it is then a back row sensor position is

I claim:

1. A miniature bowling alley game comprising:

an elongated cabinet having a front end and back end and extending side walls;

said elongated cabinet including an alley disposed within said cabinet and positioned between said front and rear ends;

said alley being defined by a first recessed gutter running along the side of said alley, and a second recessed gutter running along the opposite side of said alley, said alley further defined by the extending side walls of said cabinet, said extending side walls extending the length of said alley and being raised above said alley and said first and second recessed gutters;

means for detecting fouls affixed to said cabinet walls having the ability to send an activation signal indicating that a foul has occurred;

said rear end including means for display comprising means for displaying a simulated bowling pin arrangement having the ability to display an individual pin or a spare combination, means for displaying information on the number of bowlers, game score and frame, and positioned above said means for displaying a simulated bowling pin arrangement;

means for sensing the position of a ball as it rolls down the alley and sending an activation signal;

said front end including means for selection having the ability to control the number of players, game mode, and practice spare combination, and further including a ball return area;

said means for displaying a simulated ten pin arrangement comprising a masked translucent panel, said masked translucent panel being angled and having a ten pin arrangement adapted to display each of said ten pins individually or in combination depicting a spare combination; and a means for processing positioned behind said masked translucent panel and attached to said rear end, said means for processing having means for determining a first and a second ball spare combination, means for determining the speed of a ball, means for determining a sound effect, and the ability to receive said activation signal from said means for detecting fouls and said activation signal from said means for sensing.

2. A miniature bowling game as recited in claim 1, wherein said means for processing has the ability to determine said position of said ball, speed of said ball, a number for pins that were knocked down, and a score, said means for processing further having the ability to send a signal to said means for displaying a simulated ten pin arrangement causing it to generate a display from the group consisting of a strike or a spare combination, and the ability to send a signal to said means for displaying information causing it to display said number of pins knocked down, a strike, a spare, a frame, and said score.

3. A miniature bowling game as recited in claim 2, wherein said means for processing has the ability to cause a corresponding sound effect based upon said spare combination.

4. A miniature bowling game as recited in claim 3, wherein said means for displaying a simulated ten pin arrangement comprises twenty lamp shields having twenty lights attached to said masked translucent panel, said lamp shields being affixed to a printed circuit board whereby when all twenty lights are on said translucent panel displays a simulated ten pin arrangement.

5. A miniature bowling game as recited in claim 4, wherein said means for processing has the ability to cause a delay in a pin display light being extinguished based upon the speed of a ball.

6. A miniature bowling game as recited in claim 5, wherein said means for processing has the ability to cause said pin display light being turned off and back on simulating a wobble effect on a pin.

7. A miniature bowling game as recited in claim 4, wherein said means for processing is a microcontroller having an associated EPROM.

8. A miniature bowling game as recited in claim 5, wherein said means for sensing comprises a first row of multiple microsensors, and a second row of multiple microsensors, said first row of multiple sensors and said second row of multiple sensors being adapted in such a way so that as a ball is rolled as it passes said first row of multiple microsensors and said second row of multiple microsensors said ball shall contact a combination of the microsensors.

9. A miniature bowling game as recited in claim 6, wherein said means for determining a first ball spare combination comprises the steps:

polling the first row of multiple microsensors;

saving a first row sensor position;

polling said second row of multiple microsensors;

saving a second row sensor position and converting a ball speed to a pin count delay;

retrieving said first row sensor position and applying a limiter to begin sensor analysis;

retrieving said second row sensor position and applying a second limiter for sensor analysis;

getting a random mixer count;

determining a spare combination home position and getting a spare combination pin information;

saving a first ball spare combination home position said spare combination containing pin knockdown information, and a pin count information;

sending a pin knockdown signal to said printed circuit board and sending a sound effect signal;

sending a pin count signal to said means for displaying information; and returning for a second ball.

10. A miniature bowling game as recited in claim 9, wherein said means for determining a second ball spare combination comprises the steps:

polling the first row of multiple microsensors;

saving a first row sensor position;

polling said second row of multiple microsensors;

saving a second row sensor position;

converting a ball speed to a pin count delay;

getting a random mixer count;

getting a second ball spare combination pin information and retrieving said first ball spare combination home position;

retrieving said first row sensor position and applying a limiter to begin a sensor analysis;

retrieving said second row sensor position and applying a second limiter for sensor analysis;

comparing a first ball pin knockdown information with said second ball pin knockdown information;

sending a final pin knockdown signal to said printed circuit board and sending a sound effect signal;

sending a second ball pin count signal to said means for displaying information; and returning for next player first ball roll.

11. An improved method for simulated bowling on a miniature bowling alley comprising the steps:

determining the number of bowlers and turning on bowler indicator lights;

starting a new frame;

polling the first row of multiple microsensors;

saving a first row sensor position;

polling said second row of multiple microsensors;

saving a second row sensor position and converting a ball speed to a pin count delay;

retrieving said first row sensor position and applying a limiter to begin sensor analysis;

retrieving said second row sensor position and applying a second limiter for sensor analysis;

getting a random mixer count;

determining a spare combination home position and getting a spare combination pin information;

saving a first ball spare combination home position, said spare combination containing pin knockdown information, and a pin count information;

determining a pin knockdown sequence and a sound effect;

sending a pin knockdown signal a means for displaying a ten pin arrangement and sending a sound effect signal;

sending a pin count signal to a means for displaying information;

returning for a second ball;

polling the first row of multiple microsensors;

saving a first row sensor position;

polling said second row of multiple microsensors;

saving a second row sensor position;

converting a ball speed to a pin count delay;

getting a random mixer count;

getting a second ball spare combination pin information and retrieving said first ball spare combination home position;

retrieving said first row sensor position and applying a limiter to begin a sensor analysis;

retrieving said second row sensor position and applying a second limiter for sensor analysis;

comparing a first ball pin knockdown information with said second ball pin knockdown information;

determining a final pin knockdown sequence and a final sound effect;

sending a final pin knockdown signal to said means for displaying a ten pin arrangement and sending a sound effect signal;

sending a second ball pin count signal to said means for displaying information; and returning for next player first ball roll.

* * * * *